US007513236B2

(12) United States Patent
Miyamoto et al.

(10) Patent No.: US 7,513,236 B2
(45) Date of Patent: Apr. 7, 2009

(54) INSERT CASTING COMPONENT, CYLINDER BLOCK, METHOD FOR FORMING COATING ON INSERT CASTING COMPONENT, AND METHOD FOR MANUFACTURING CYLINDER BLOCK

(75) Inventors: Noritaka Miyamoto, Toyota (JP); Masaki Hirano, Toyota (JP); Toshihiro Takami, Toyota (JP); Kouhei Shibata, Toyota (JP); Nobuyuki Yamashita, Shiojiri (JP); Toshihiro Mihara, Matsumoto (JP); Giichiro Saito, Yamagata (JP); Masami Horigome, Yamagata (JP); Takashi Sato, Yamagata (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 392 days.

(21) Appl. No.: 11/481,015

(22) Filed: Jul. 6, 2006

(65) Prior Publication Data

US 2007/0009669 A1 Jan. 11, 2007

(30) Foreign Application Priority Data

Jul. 8, 2005 (JP) ..... 2005-201003

(51) Int. Cl.
*F02F 1/00* (2006.01)
*B22D 19/00* (2006.01)

(52) U.S. Cl. ..... 123/193.2; 164/75

(58) Field of Classification Search ..... 164/75, 164/100, 91; 123/193.2; 29/527.3, 888.061
See application file for complete search history.

(56) References Cited

U.S. PATENT DOCUMENTS 5,179,994 A * 1/1993 Kuhn ..... 164/100
5,293,923 A * 3/1994 Alabi ..... 164/102
5,429,173 A * 7/1995 Wang et al. ..... 164/75

FOREIGN PATENT DOCUMENTS

| | | |
|---|---|---|
| CH | 321 966 A | 5/1957 |
| DE | 103 47 510 B3 | 4/2005 |
| EP | 0 659 899 A | 6/1995 |
| JP | 53-163405 | 12/1978 |
| JP | 2003-053508 | 2/2003 |
| JP | 2003-120414 | 4/2003 |
| WO | WO 01/58621 A1 | 8/2001 |

OTHER PUBLICATIONS

International Search Report, PCT/JP2006/313927 dated Jun. 11, 2006.
Written Opinion of the International Searching Authority, PCT/JP2006/313927.

* cited by examiner

*Primary Examiner*—M. McMahon
(74) *Attorney, Agent, or Firm*—Kenyon & Kenyon LLP

(57) ABSTRACT

A liner outer surface is coated by a sprayed layer or a heterogeneous metal layer including a base metal phase and dispersed metal phases. During casting, liquid metal enters the sprayed layer from the dispersed metal phases and solidifies in a virtual vegetation root state. The surface of the cylinder block is thus rigidly fixed to the surface of the cylinder liner. In this case, a strong bonding force is produced between the cylinder block and the cylinder liner and high thermal conductivity is obtained compared to the prior art in which the liquid metal merely contacts a surface layer.

26 Claims, 11 Drawing Sheets

Cylinder Liner Manufacturing Process

Manufacturing Process of Cylinder Liner

Contour Map

1st Contour Map

2nd Contour Map

INSERT CASTING COMPONENT, CYLINDER BLOCK, METHOD FOR FORMING COATING ON INSERT CASTING COMPONENT, AND METHOD FOR MANUFACTURING CYLINDER BLOCK

BACKGROUND OF THE INVENTION

The present invention relates to an insert casting component having an outer surface insert cast in cast metal, a method for forming a coating on the insert casting component, a cylinder block using the insert casting component as a cylinder liner, and a method of manufacturing the same.

Insert casting is performed to integrate, for example, a cylinder liner, which serves as an insert casting component, with a cylinder block in cast metal. The cylinder liner forms a cylinder bore in the cylinder block. It is important that a strong bonding force be produced between the outer surface of the cylinder liner and the cylinder block to maintain the roundness of the cylinder bore.

It is also extremely important that the properties of the outer surface of the cylinder liner be adjusted to produce a strong bonding force between the outer surface of the cylinder liner and the cylinder block. Accordingly, Japanese Laid-Open Utility Model Publication No. 53-163405 proposes coating the outer surface of the cylinder liner with a sprayed layer. In Japanese Laid-Open Utility Model Publication No. 53-163405, grains of metal are adhered in an irregular manner to the outer surface of the cylinder liner to form pits in the outer surface. During casting, liquid metal flows into the pits. This produces an anchoring effect that generates a strong bonding force between the outer surface of the cylinder liner and the cylinder block.

Japanese Laid-Open Patent Publication No. 2003-53508 proposes metallurgical application of a coating of a low melting point material to the outer surface of a cylinder liner by performing shot peening, plasma spray, or the like. This resists the formation of an oxidized film on the outer surface of the cylinder liner and improves adhesion between the outer surface of the cylinder liner and the cylinder block.

Japanese Laid-Open Patent Publication No. 2003-120414 proposes the formation of an active layer of aluminum alloy on the outer surface of a cylinder liner at the top dead point region and the bottom dead point region of a piston. This bonds the cylinder liner with metal to a crankcase.

Internal combustion engines have become lighter while increasing output. As a result, the intervals between cylinder bores have become narrower. Thus, for a cylinder block formed by insert casting a cylinder liner with cast metal, it is required that the bonding force between the cylinder liner and the cylinder block be further increased.

In Japanese Laid-Open Utility Model Publication No. 53-163405, recesses are formed in the outer surface of a cylinder liner to receive liquid metal during casting. Thus, part of the cylinder block is anchored in the recesses to the outer surface of the cylinder liner. However, since liquid metal only contacts the outer surface of the cylinder liner, there is a limit to the anchoring with the recesses in the outer surface of the cylinder liner. Thus, sufficient bonding force cannot be obtained with only the recesses in the outer surface of the cylinder liner.

In Japanese Laid-Open Patent Publication No. 2003-53508, a coating having a low melting point is applied to the outer surface of the cylinder liner. During casting, the coating contacts liquid metal. This produces a thermal effect and fuses the coating thereby obtaining satisfactory metallic bonding. However, the entire coating is entirely formed of only low melting point material. Although this improves thermal conductivity, sufficient bonding force just through contact of liquid metal with a homogeneous film.

In Japanese Laid-Open Patent Publication No. 2003-120414, an active layer having a melting point lower than that of the cylinder liner is formed. However, the active layer is formed from a homogeneous aluminum alloy. Thus, sufficient bonding force cannot be obtained just by melting the surface of the active layer.

SUMMARY OF THE INVENTION

It is an object of the present invention to provide an insert casting component, such as a cylinder liner, having an outer surface insert cast in cast metal so that a stronger bonding force is produced between a metal layer, which serves as a surface layer of the insert casting component, and cast metal that forms the cylinder block.

One aspect of the present invention is an insert casting component including an outer surface insert cast in cast metal. The outer surface has a coating of a heterogeneous metal layer. The heterogeneous metal layer includes one or more dispersed metal phases in a base metal phase. At least one of the dispersed metal phases is a low melting point metal phase made of a metal having a melting point lower than that of the base metal phase and the cast metal.

Another aspect of the present invention is a cylinder block provided with a cylinder liner including an outer surface insert cast in cast metal. The outer surface has a coating of a heterogeneous metal layer. The heterogeneous metal layer includes one or more dispersed metal phases in a base metal phase. At least one of the dispersed metal phases is a low melting point metal phase made of a metal having a melting point lower than that of the base metal phase and the cast metal.

A further aspect of the present invention is a method for forming a coating on an insert casting component including an outer surface insert cast in cast metal. The method includes the step of spraying the outer surface with plural types of metal material simultaneously, including a low melting metal material having a melting point lower than that of the cast metal and a high melting point metal material having a melting point higher than that of the low melting point metal material, and forming a heterogeneous metal layer in which low melting point metal phases of the low melting point metal material are dispersed in a high melting point metal phase of the high melting point metal material.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

A first embodiment of the present invention will now be described with reference to FIGS. 1 to 4.

<Structure of Cylinder Liner 2>

Figure 1B:
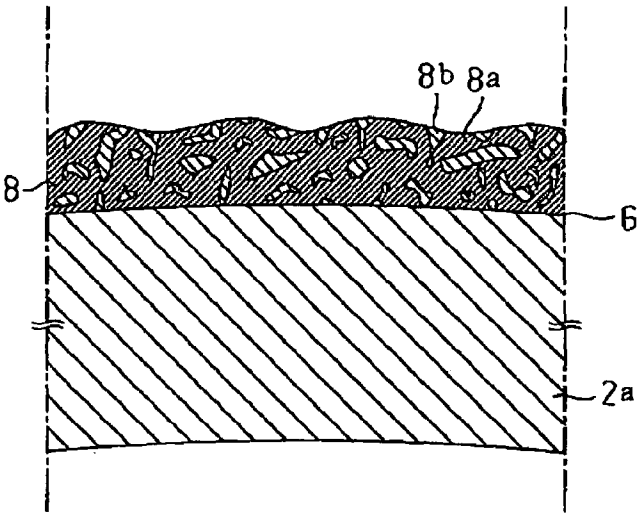
FIG. 1(B) is a partially enlarged cross-sectional view showing the vicinity of a surface of the cylinder liner.
Figure 1A:
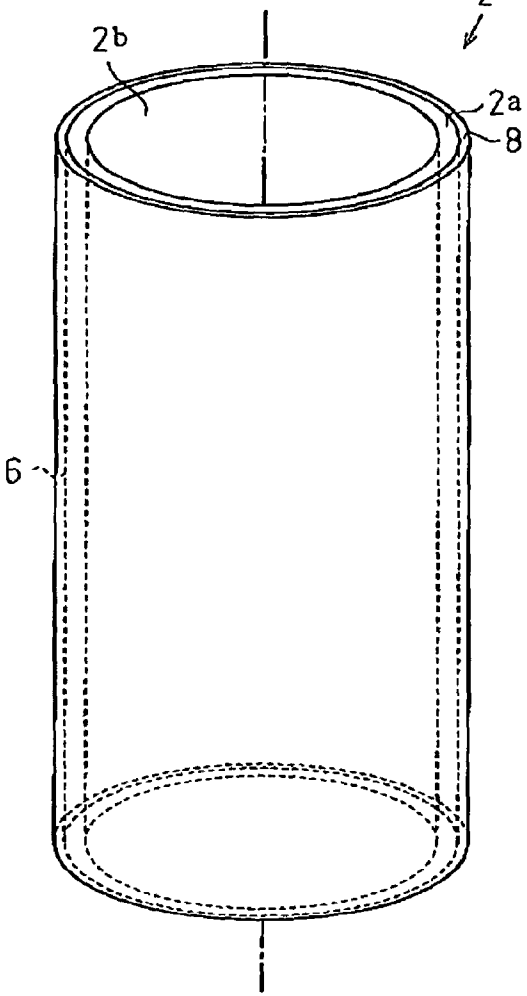
FIG. 1(A) is a perspective showing the entire structure of a cylinder liner according to a first embodiment of the present invention.

As shown in FIG. 1(A), a main body 2*a* of the cylinder liner 2 is a cylindrical body made of cast iron. A sprayed layer 8 is formed on the outer surface 6 of the cylinder liner main body 2*a* (hereinafter referred to as the "liner outer surface"). The sprayed layer 8 is arranged on the liner outer surface 6 to metallurgically bond the cylinder liner 2 to a cylinder block 4 during casting.

The composition of the cast iron is preferably set as shown below taking into consideration wear resistance, seizing resistance, and machinability.

T.C: 2.9% by mass to 3.7% by mass
Si: 1.6% by mass to 2.8% by mass
Mn: 0.5% by mass to 1.0% by mass
P: 0.05% by mass to 0.4% by mass
The remainder is Fe.

If necessary, the following compositions may be added.

Cr: 0.05% by mass to 0.4% by mass
B: 0.03% by mass to 0.08% by mass
Cu: 0.3% by mass to 0.5% by mass <Structure of Sprayed Layer 8>

As shown in FIG. 1(B), the sprayed layer 8 coating the cylinder liner main body 2*a* is a heterogeneous metal layer including a plurality of metal phases (two metal phases in the present embodiment) in a dispersed state. The sprayed layer 8 mainly includes a base metal phase 8*a* (corresponds to high melting point metal phase and highly thermal conductive metal phase) formed of a high melting point metal material (aluminum or aluminum alloy). The base metal phase 8*a* includes dispersed metal phases 8*b* (corresponds to low melting point metal phase) formed of low melting point metal material (zinc or zinc alloy). The dispersed metal phases 8*b* each have the shape of an amorphous island and are distributed throughout the entire base metal phase 8*a*.

<Formation of Sprayed Layer 8>

When forming the sprayed layer 8 on the liner outer surface 6, a roughening device (blast processing device or water jet device) performs a roughening process on the liner outer surface 6.

After the roughening process, a spraying device (plasma spraying device or high velocity oxygen fuel (HVOF) spraying device) sprays the liner outer surface 6. A powdered material of a mixture of a powder of high melting point metal material and a powder of low melting point metal material is sprayed onto the liner outer surface 6 to form the sprayed layer 8.

Aluminum or an aluminum alloy is used as the high melting point metal material. Aluminum and aluminum alloy have substantially the same melting point (approx. 660° C.) as the cast metal forming the block material of the cylinder block 4. In this case, the same metal powder as that of the block material may be used.

Zinc or a zinc alloy is used as the low melting metal material. Zinc and zinc alloy have a melting point (approx. 420° C.) that is lower than the block material and the high melting point metal material. The mixed ratio of the high melting point metal material powder and the low melting point metal material powder is adjusted so that the volume ratio of the low melting point metal material contained in the mixed powder becomes, for example less than 50%. Referring to FIG. 1(B), the dispersed metal phases 8*b* made of the low melting point metal material are the portions where the liquid metal enters the sprayed layer 8 when casting the cylinder block 4. The lower limit value of the mixed ratio of the low melting point metal material must be set to a value that enables the liquid metal to sufficiently enter the sprayed layer 8. The mixed ratio of the low melting point metal material differs depending on the size of the powder grains, the spraying conditions, and so on. However, the lower limit value of the mixed ratio is set here so that the volume ratio is 5% to 10%.

During the spraying, the melted grains of the high melting point metal material and the low melting point metal material simultaneously collide against the liner outer surface 6. The high melting point metal material and the low melting point material do not mix evenly in such collision. That is, the metal phase of the high melting point metal material and the metal phase of the low melting point metal material solidify independent from each other except at fusing interfaces of the metal phases. Thus, the sprayed layer 8 is formed as a heterogeneous metallic layer in which the amorphous dispersed metal phases 8*b* are dispersed throughout the entire base metal phase 8*a*.

<Structure and Casting of Cylinder Block 4>

Figure 2B:
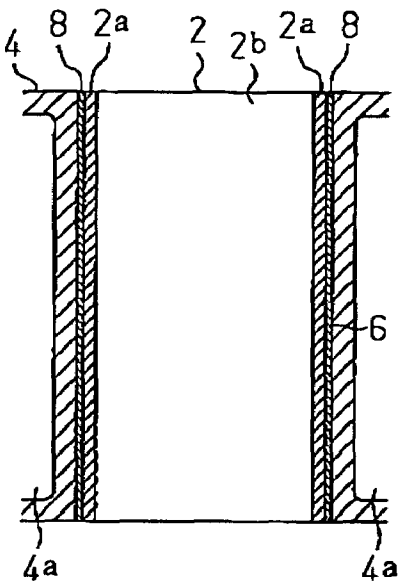
FIG. 2(B) is a partial cross-sectional view showing the vicinity of the cylinder liner of the cylinder block.
Figure 2A:
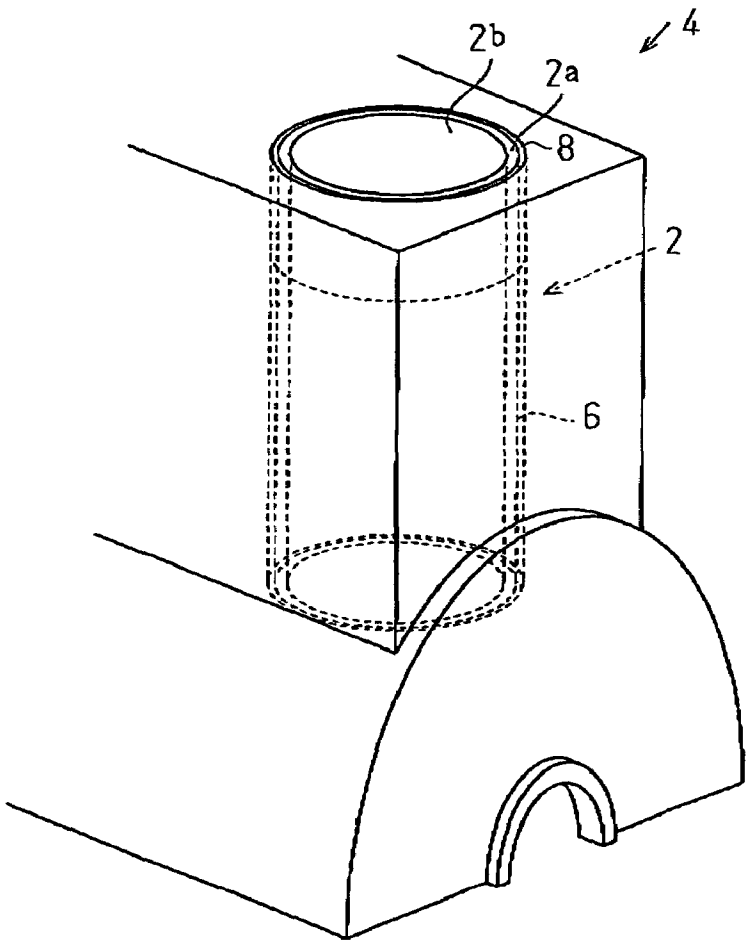
FIG. 2(A) is a partial perspective view showing the vicinity of the cylinder liner of a cylinder block.

As shown in FIG. 2(A), the cylinder block 4 is formed so that the liner outer surface 6 of the cylinder liner 2 is insert cast by the cast metal. A light alloy material is used as the cast metal, that is, the block material for forming the cylinder block. In particular, aluminum or aluminum alloy may be used from the viewpoint of decreasing weight and cost. The materials described in, for example, "JIS ADC10 (corresponding standard: US ASTM A 380.0)", "JIS ADC12 (corresponding standard: ASTM A 383.0)", or the like are used as the aluminum alloy.

The cylinder liner 2 is arranged in a casting mold. Then, liquid metal of aluminum or aluminum alloy is poured into the casting mold. This forms the cylinder block 4 with the liner outer surface 6 of the cylinder liner 2, that is, the entire periphery of the sprayed layer 8 insert cast by aluminum or aluminum alloy. A water jacket 4*a* shown in FIG. 2(B) is formed around the cylinder liner 2 in the cylinder block 4.

Figure 3:
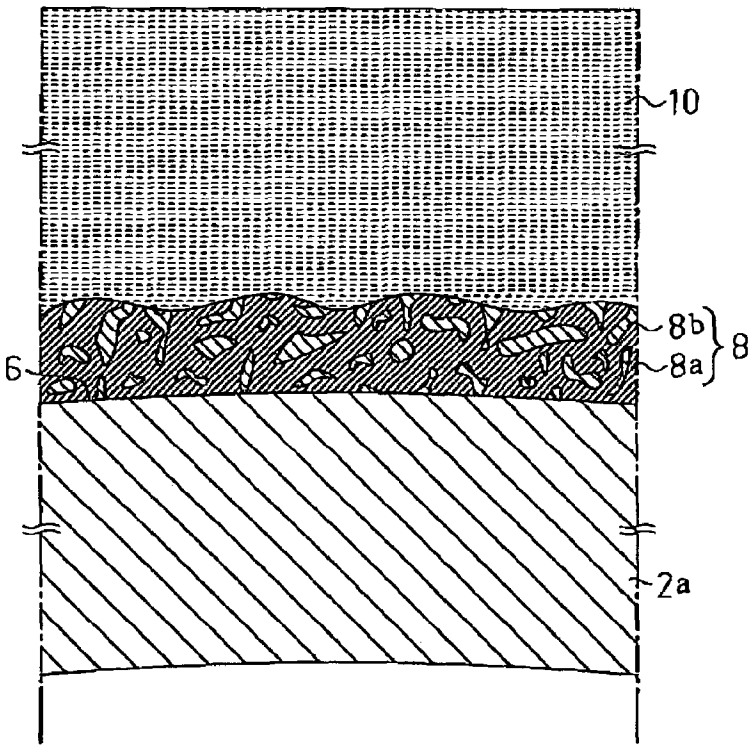
FIG. 3 is a partially enlarged cross-sectional view showing the vicinity of a sprayed layer during the formation of the cylinder block.

Referring to FIG. 3, the liquid metal 10 heats the sprayed layer 8 formed on the liner outer surface 6 during casting. The sprayed layer 8 is formed with the dispersed metal phases 8*b* dispersed throughout the entire base metal phase 8*a*. The melting point of the dispersed metal phases 8*b* is lower than the melting point of the base metal phase 8*a* and the block material (cast metal). Thus, the dispersed metal phases 8*b* melt into a liquid state faster than the base metal phase 8*a* as they contact the liquid metal 10.

Figure 4:
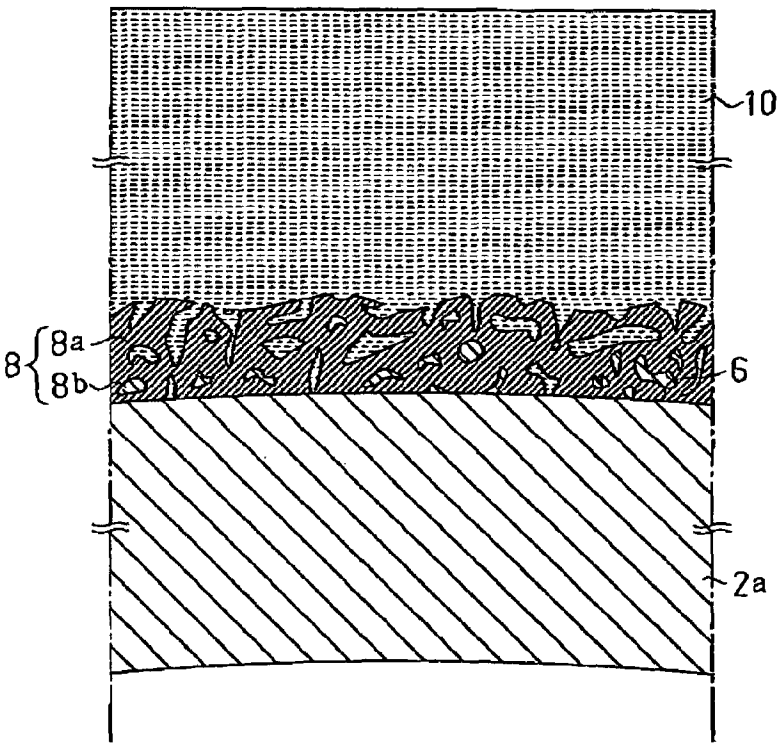
FIG. 4 is a partially enlarged cross-sectional view showing the vicinity of the sprayed layer during the formation of the cylinder block.

The liquid metal 10 enters the regions of the dispersed metal phases 8*b* in the base metal phase 8*a* while mixing with the melted dispersed metal phase 8*b*. The liquid metal 10 then rapidly forms a continuous shape connecting the dispersed metal phases 8*b* near the surface of the sprayed layer 8 to the dispersed metal phases 8*b* in the sprayed layer 8. The liquid metal 10 thus forms the shape of virtual vegetation root as shown in FIG. 4 by entering into the sprayed layer 8.

Subsequently, the liquid metal 10 in the casting mold is cooled and solidified. This completes the casting of the cylinder block 4.

The first embodiment has the advantages described below.

(1) The liner outer surface 6 is coated by the sprayed layer 8, which is a heterogeneous metal layer including the base metal phase 8*a* and the dispersed metal phases 8*b*. During casting, the liquid metal 10 enters the sprayed layer 8 through the dispersed metal phases 8*b* and solidifies in the virtual vegetation root state. Since part of the cylinder block 4 enters the sprayed layer 8 in the virtual vegetation root state, the surface of the cylinder block 4 is rigidly fixed to the surface of the cylinder liner 2. Therefore, a stronger bonding force is obtained than the prior art in which the liquid metal just contacts the surface layer of the cylinder liner 2.

(2) The sprayed layer 8 is formed by spraying the liner outer surface 6 with a mixture of aluminum or aluminum alloy, which are high melting point metals, and zinc or zinc alloy, which are low melting point metals, in a powdered state. This easily forms the sprayed layer 8 including the base metal phase 8*a* and the dispersed metal phases 8*b*.

(3) The base metal phase 8*a* is a material having high thermal conductivity such as aluminum and aluminum alloy. Thus, part of the cylinder block 4 is formed in a virtual vegetation root state so as to intertwine with the base metal phase 8*a*. This obtains high thermal conductivity near the cylinder liner 2 and high cooling performance of the cylinder bore 2*b*.

Second Embodiment

A second embodiment of the present invention will now be described with reference to FIGS. 5 to 10. Parts in the second embodiment that are similar to those of the first embodiment will not be described here.

<Structure of Cylinder Liner 12>

Figure 5:
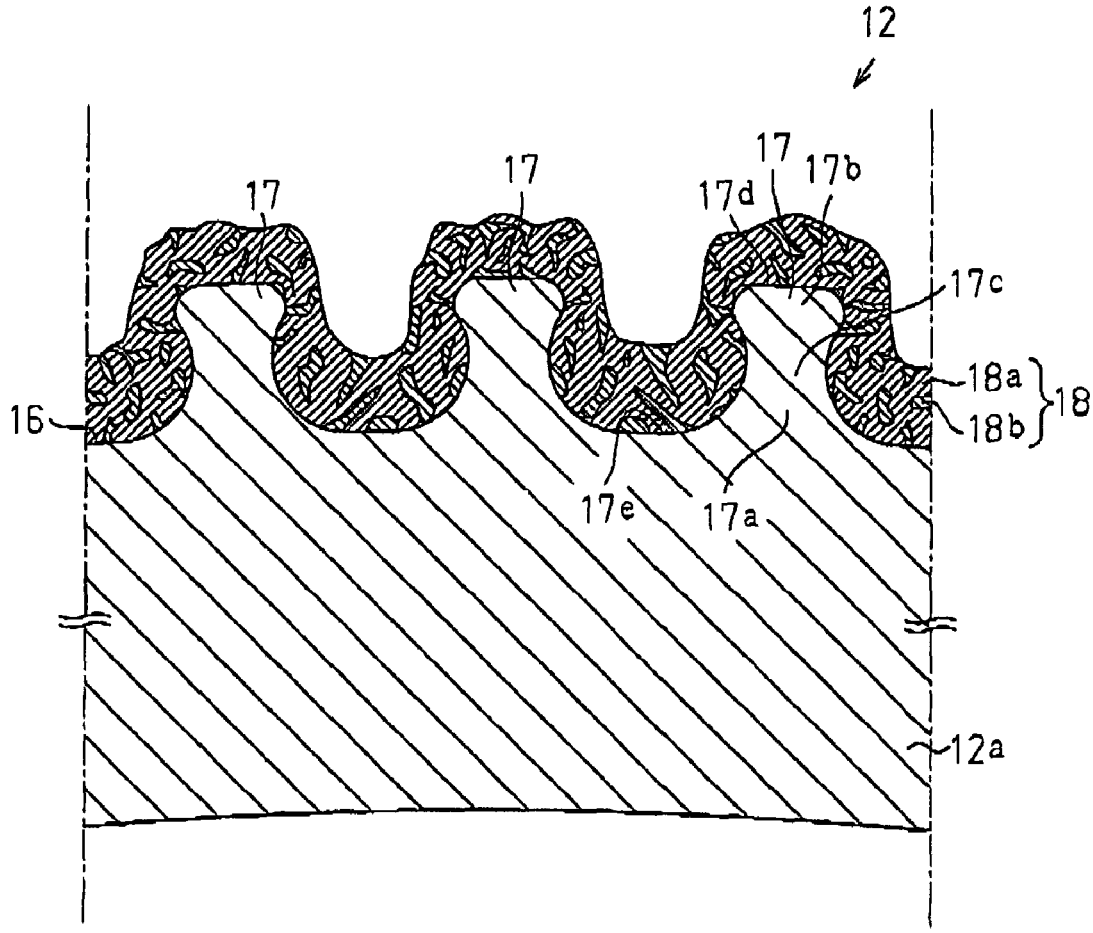
FIG. 5 is a partially enlarged cross-sectional view showing the vicinity of the surface of a cylinder liner according to a second embodiment of the present invention.

As shown in FIG. 5, a plurality of bottleneck-shaped projections 17 are formed on a liner outer surface 16. The projection 17 has the following features.

(1) The narrowest part (neck portion 17*c*) of each projection 17 is located between a basal portion 17*a* and a distal portion 17*b*.

(2) The diameter of the projection 17 increases from the neck portion 17*c* towards the basal portion 17*a* and the distal portion 17*b*.

(3) Each projection 17 has a generally flat top surface 17*d* (radially outermost surface of a cylinder liner main body 12*a*) at the distal portion 17*b*.

(4) A generally flat surface (bottom surface 17*e*) is formed between neighboring projections 17.

After roughening the liner outer surface 16, a sprayed layer 18 is formed on the liner outer surface 16 to metallurgically bond the cylinder liner 2 to the cylinder block 4 during casting.

<Manufacturing Step of Cylinder Liner 12>

Figure 6:
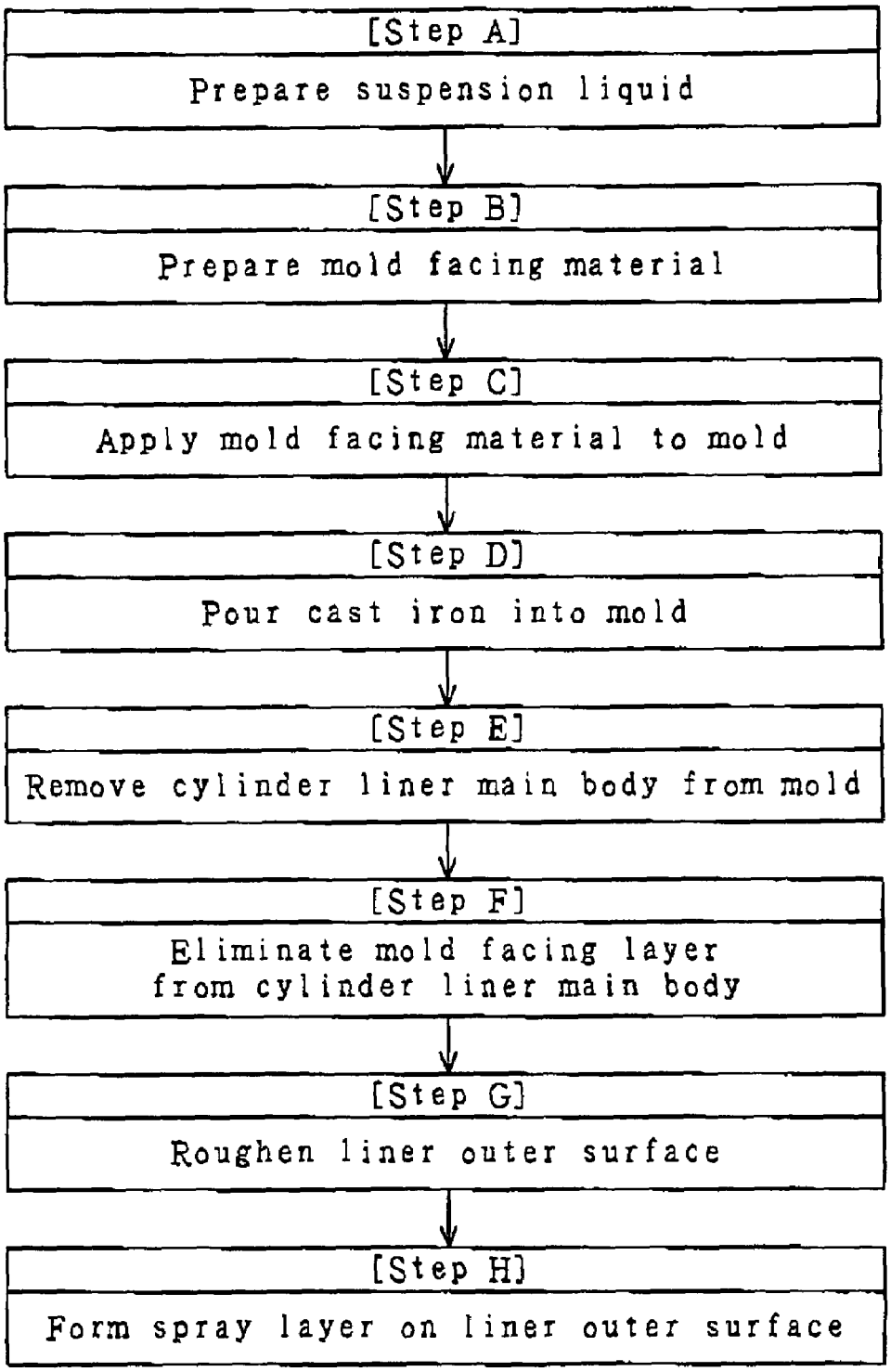
FIG. 6 is a flowchart showing the procedures for manufacturing the cylinder liner.
Figure 7:
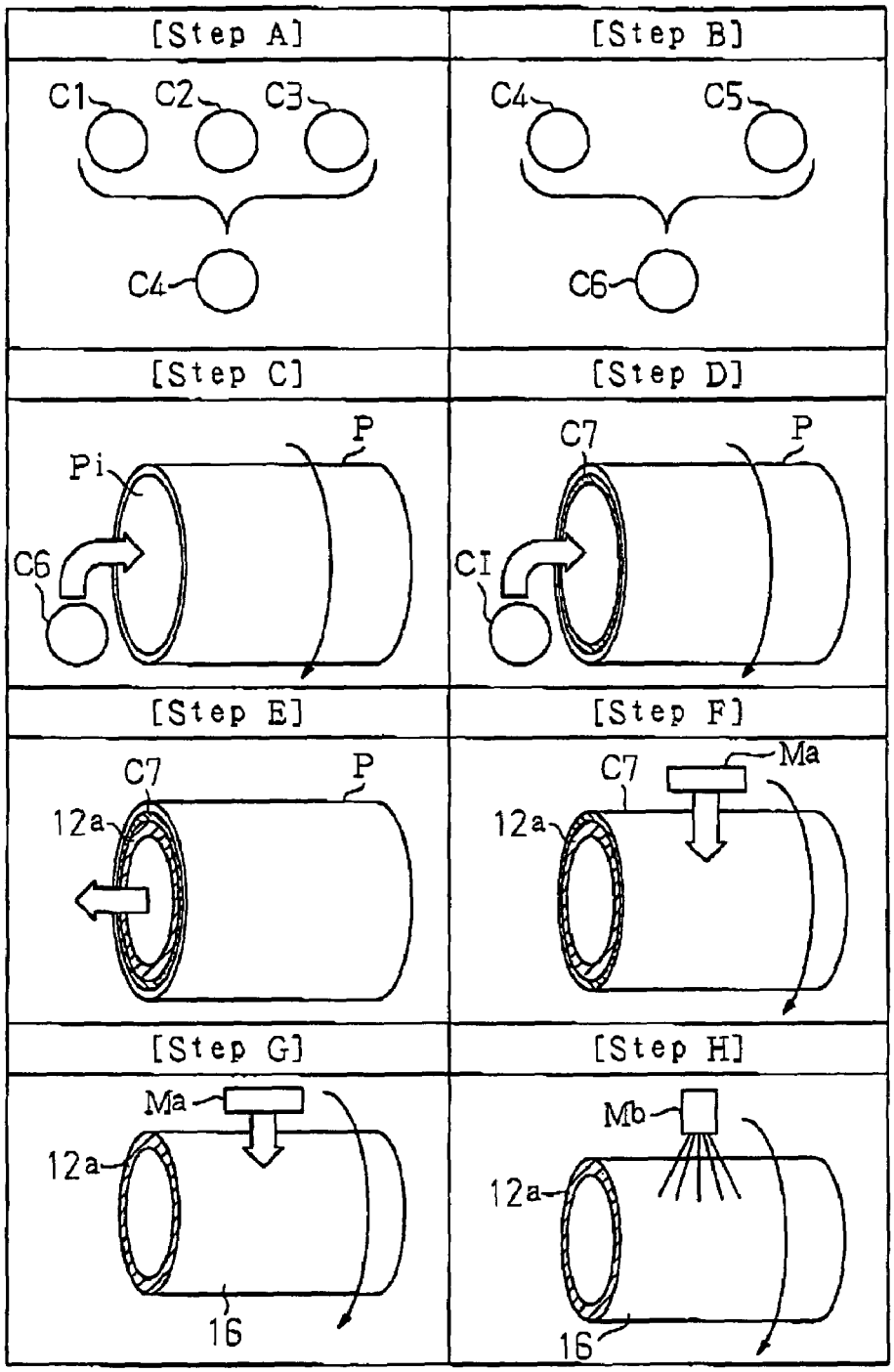
FIG. 7 is an explanatory diagram showing the procedures for manufacturing the cylinder liner.

Steps A to H shown in FIG. 6 are performed to manufacture the cylinder liner 12. The manufacturing of the cylinder liner 12 will be described in detail with reference to FIG. 7.

[Step A]

A fire resistance base C1, a bonding agent C2, and water C3 are mixed at a predetermined ratio to prepare a suspension liquid C4.

In the present embodiment, the ranges of the selectable compound amount for the fire resistance base C1, bonding agent C2, and water C3, and the average grain diameter of the fire resistance base C1 are set as shown below.

Compound amount of fire resistance base C1: 8% by mass to 30% by mass

Compound amount of bonding agent C2: 2% by mass to 10% by mass

Compound amount of water C3: 60% by mass to 90% by mass

Average grain diameter of the fire resistance base C1: 0.02 mm to 0.1 mm.

[Step B]

A predetermined amount of a surface active agent C5 is added to the suspension liquid C4 to prepare a mold facing material C6.

In the present embodiment, the range of the selectable additive amount of the surface active agent C5 is set as shown below.

The additive amount of the surface active agent C5: 0.005% by mass $<X\leqq 0.1\%$ by mass (X being the additive amount).

[Step C]

A mold P (casting mold) heated to a predetermined temperature is rotated to spray and apply the mold facing material C6 to the inner surface Pi of the mold P. A layer (mold facing layer C7) of the mold facing material C6 is formed with a generally even thickness throughout the entire inner surface Pi of the mold P.

In the present embodiment, the range for the selectable thickness of the mold facing layer C7 is set as shown below.

Thickness of the mold facing layer C7: 0.5 mm to 1.5 mm

Figure 8:
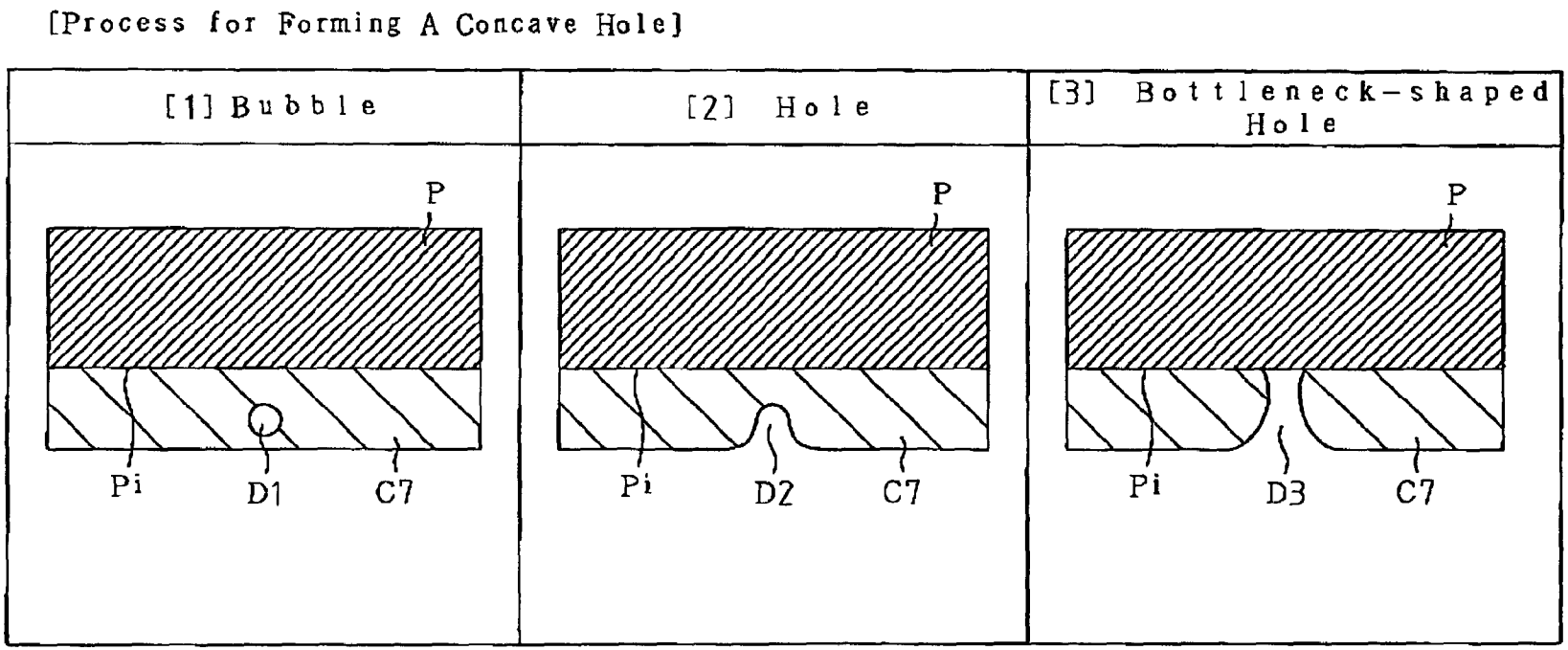
FIG. 8 is an explanatory diagram showing a process for forming a constricted concave hole in a casting mold.

FIG. 8 shows a state in which a bottleneck-shaped hole is formed in the mold facing layer C7.

Referring to FIG. 8, the surface active agent C5 acts on air bubbles D1 in the mold facing layer C7 and forms holes D2 in the surface of the mold facing layer C7. As each hole D2 extends to the inner surface Pi of the mold P, a bottleneck-shaped hole D3 forms in the mold facing layer C7.

[Step D]

After drying the mold facing layer C7, liquid metal CI of cast iron is poured into the rotating mold P to cast the cylinder liner main body 12*a*. The shapes of the holes D3 are transferred to the outer surface of the cylinder liner main body 12*a* at positions corresponding to the holes D3 in the mold facing layer C7. This forms the bottleneck-shaped projections 17 (see FIG. 5).

[Step E]

After the liquid metal CI hardens and forms the cylinder liner main body 12*a*, the cylinder liner main body 12*a* is removed from the mold P together with the mold facing layer C7.

[Step F]

The mold facing layer C7 is eliminated from the outer surface of the cylinder liner main body 12*a* with a blast processing device Ma.

[Step G]

A roughening process is performed on the liner outer surface 16 with the roughening device (blast processing device Ma or other blast processing devices or a water jet device).

[Step H]

The mixture of the powdered high melting point metal material and the powdered low melting point metal material is sprayed onto the liner outer surface 16 with the spraying device Mb. The sprayed layer 18 is formed as a heterogeneous metal layer in which the amorphous dispersed metal phases 18*b* (corresponding to low melting point metal phases) are distributed in the base metal phase 18*a* (corresponding to high melting point metal phase). The cylinder liner 12 shown in FIG. 5 is manufactured through the above steps.

<Area Ratio of Projections 17>

In the present embodiment, the selectable range of the first area ratio S1 and the second area ratio S2 of the projections 17 subsequent to step F is set as shown below.

First area ratio S1: greater than or equal to 10%

Second area ratio S2: less than or equal to 55%

Alternatively, the range may be set as shown below.

First area ratio S1: 10% to 50%

Second area ratio S2: 20% to 55%

The first area ratio S1 is equivalent to the cross-sectional area of the projections 17 per unit area of the liner outer surface 16 along a plane lying at a height of 0.4 mm from the bottom surface 17*e* (distance in the height direction of the projections 17 using the bottom surface 17*e* as a reference).

The second area ratio S2 is equivalent to the cross-sectional area of the projection 17 per unit area of the liner outer surface 16 along a plane lying at a height of 0.2 mm from the bottom surface 17*e* (distance in the height direction of the projections 17 using the bottom surface 17*e* as a reference).

The area ratios S1 and S2 are obtained from contour maps (FIGS. 12 and 13) of the projections 17 generated by a three-dimensional laser measuring equipment.

The height and distribution density of the projections 17 are determined by the depth and distribution density of the holes D3 in the mold facing layer C7 formed in step C. The mold facing layer C7 is formed so that the height of the projections 17 is 0.5 mm to 1.5 mm, the number of the projections 17 is 5 to 60 per $cm^2$ of the liner outer surface 16.

<Structure and Manufacturing of Cylinder Block>

The cylinder block is formed with the liner outer surface 26 of the cylinder liner 12 insert cast in cast metal. Light alloy material used as the cast metal for forming the cylinder block, that is, the block material is the same as that of the first embodiment.

Figure 10:
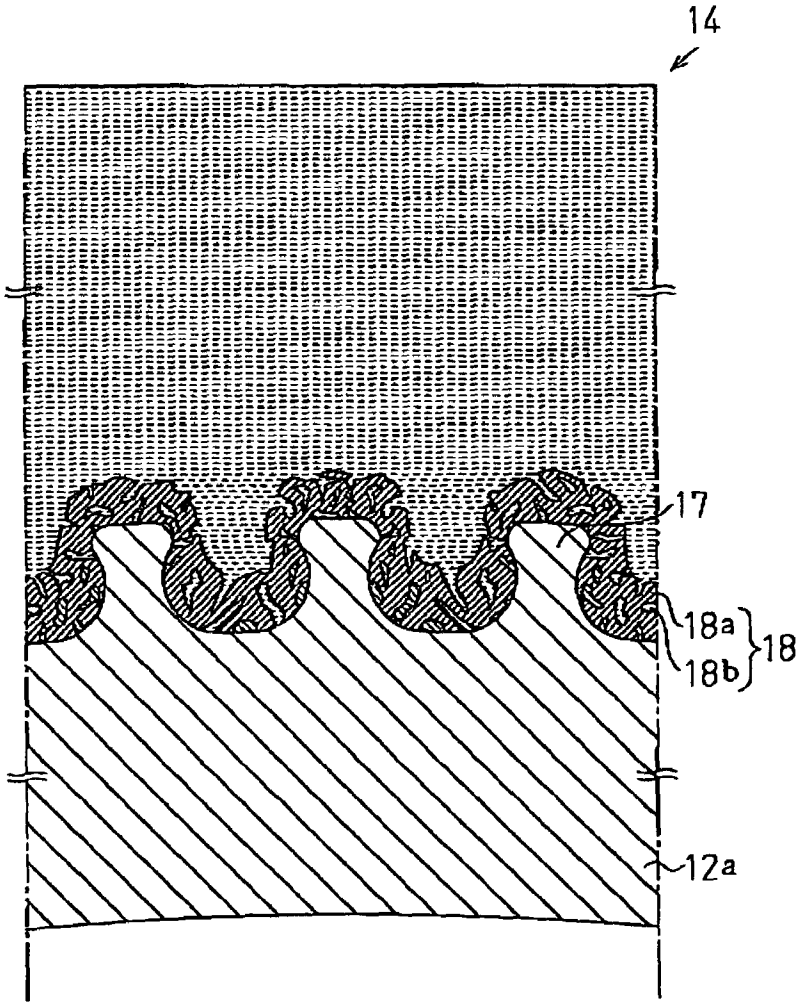
FIG. 10 is an enlarged cross-sectional view showing the vicinity of the sprayed layer during the formation of the cylinder block.
Figure 9:
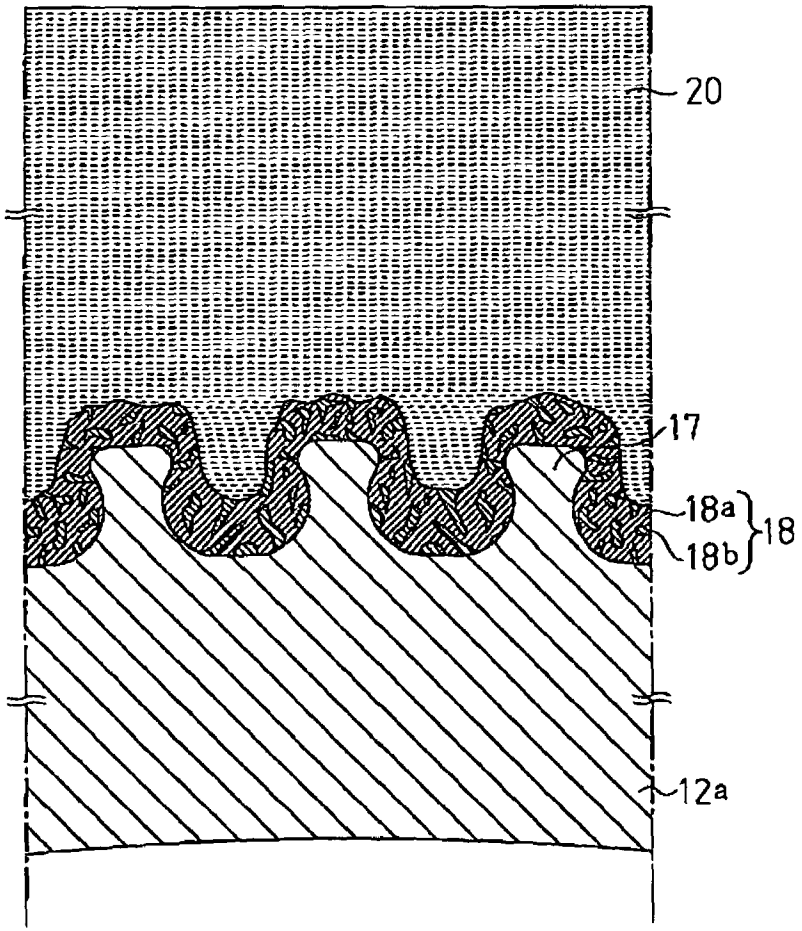
FIG. 9 is an enlarged cross-sectional view showing the vicinity of the sprayed layer during the formation of the cylinder block.

The cylinder liner 12 shown in FIG. 5 is arranged in the casting mold, and the liquid metal 20 of aluminum or aluminum alloy is poured into the casting mold (see FIG. 9). The entire periphery of the sprayed layer 18 is insert cast by aluminum or aluminum alloy to form the cylinder block 14, as shown in FIG. 10.

Like the first embodiment, in the cylinder block 14, the liquid metal 20 enters the sprayed layer 18 in a virtual vegetation root state. The liquid metal 20 in the casting mold is then solidified, and the casting of the cylinder block 14 is completed. The portion that contacts the sprayed layer 18 in the cylinder block 14 enters the sprayed layer 18 in the virtual vegetation root state and solidifies.

The second embodiment has the advantages described below.

(1) In the cylinder liner 12, in addition to the bonding that results from spraying, the sprayed layer 18 and the cylinder liner main body 12*a* are bonded by the bottleneck-shaped projections 17. This further strengthens the bonding force between the cylinder liner main body 12*a* and the sprayed layer 18 and between the cylinder liner main body 12*a* and the cylinder block 14 by way of the sprayed layer 18. The roundness of the cylinder bore is thus satisfactorily maintained.

Further, the bottleneck-shaped projections 17 result in high heat conductivity from the cylinder liner main body 12*a* to the cylinder block 14 and high cooling performance of the cylinder bore 2*b*.

Third Embodiment

Figure 11:
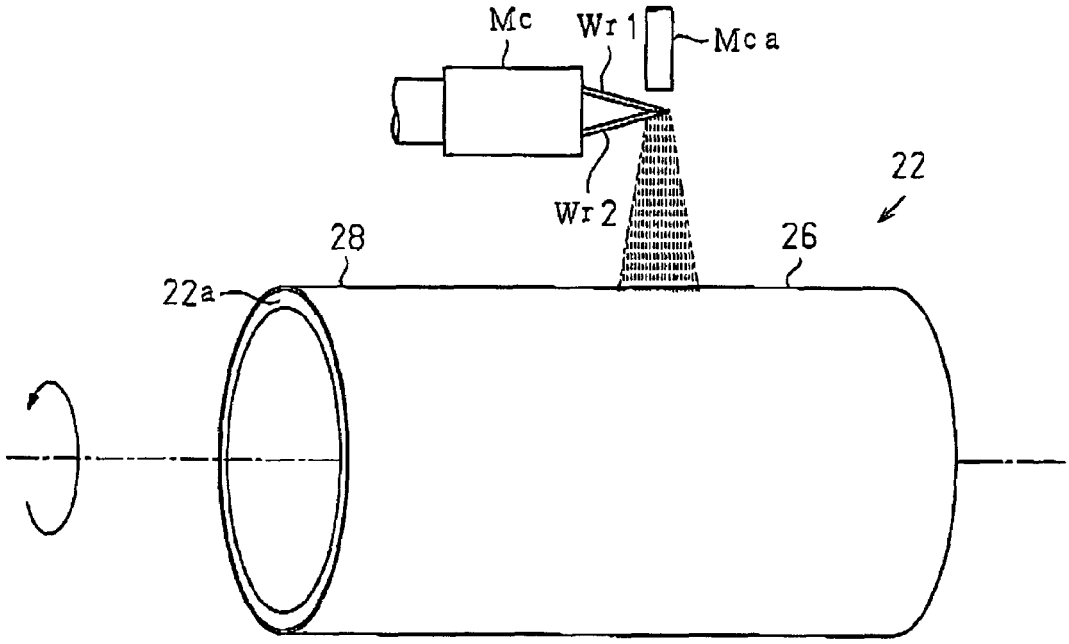
FIG. 11 is an explanatory diagram showing an electric arc spraying process according to a third embodiment of the present invention.

The cylinder liner 22 shown in FIG. 11 has a sprayed layer 28 formed on a cylinder liner main body 22*a*, which has the same structure as that of the first embodiment, using plural types (two types in the present embodiment) of wire materials Wr1 and Wr2 and an electric arc spraying device Mc.

The electric arc spraying device Mc performs arc discharge between the two types of wire materials Wr1 and Wr2 to melt the wire materials Wr1 and Wr2. The melted grains are blasted against an liner outer surface 26 of the cylinder liner main body 22*a* by compressed air ejected from a compressed air nozzle Mca. The melted grains blasted from between the wire materials Wr1 and Wr2 by the compressed air nozzle Mca do not mix evenly. That is, the metal phase of high melting point metal material and the metal phase of low melting point metal material solidify independent from each other except at fusing interfaces of the metal phases. The sprayed layer 28 is thus formed as a heterogeneous metal layer in which the amorphous dispersed metal phases are dispersed throughout the entire base metal phase, as shown in FIG. 1(B).

The first wire material Wr1 and the second wire material Wr2 differ in material and structure to form the heterogeneous metal layer. The first wire material Wr1 is made of aluminum. The second wire material Wr2 is made of two types of metal have separate forms. More specifically, the second wire material Wr2 may be formed by axially twisting or laminating aluminum wire and zinc wire or by a zinc wire inserted into a hollow aluminum wire.

In the same manner as the first embodiment, the sprayed layer 28 is formed in a state in which zinc, which is used as the dispersed metal phases, is dispersed throughout the entire base metal phase, which is made of aluminum.

Taking into consideration that the first wire material Wr1 is entirely made of aluminum, the volume ratio of the zinc phases in the sprayed layer 28 is adjusted by changing the proportion of the cross-sectional areas of the aluminum portion and zinc portions in the second wire material Wr2.

The second wire material Wr2 and the first wire material Wr1 may be made of the same material. In this case, the volume ratio of the zinc phases in the sprayed layer 28 is adjusted by changing the proportion of the cross-sections of the aluminum portion and the zinc portion for both wire materials Wr1 and Wr2.

The third embodiment has the same advantages as the first embodiment.

Fourth Embodiment

In the present embodiment, a sprayed layer is formed on the cylinder liner main body, which has the same structure as the second embodiment, through electric arc spraying using the electric arc spraying device Mc shown in FIG. 11. This forms the cylinder liner shown in FIG. 5, and a cylinder block is manufactured by insert casting the cylinder liner shown in FIG. 10.

The forth embodiment has the same advantages as the second embodiment.

[Description of Contour Map of Projections 17]

With regard to the projections 17 of the second embodiment, the contour map obtained with the three-dimensional non-contact type laser measuring equipment will now be discussed with reference to FIGS. 12 and 13.

<Contour Map of Projections 17>

First, the method for measuring the contour lines of each projection 17 will be described.

A test piece for contour line measurement is set on a testing platform to generate the contour map. The bottom surface 17*e* (liner outer surface 16) of the test piece is arranged facing toward the three-dimensional laser measuring equipment. A laser beam is irradiated so as to be substantially orthogonal to the liner outer surface 16. The measurement result obtained through the laser irradiation is retrieved by an image processing device to generate the contour map shown in FIG. 12(A).

Figure 12A:
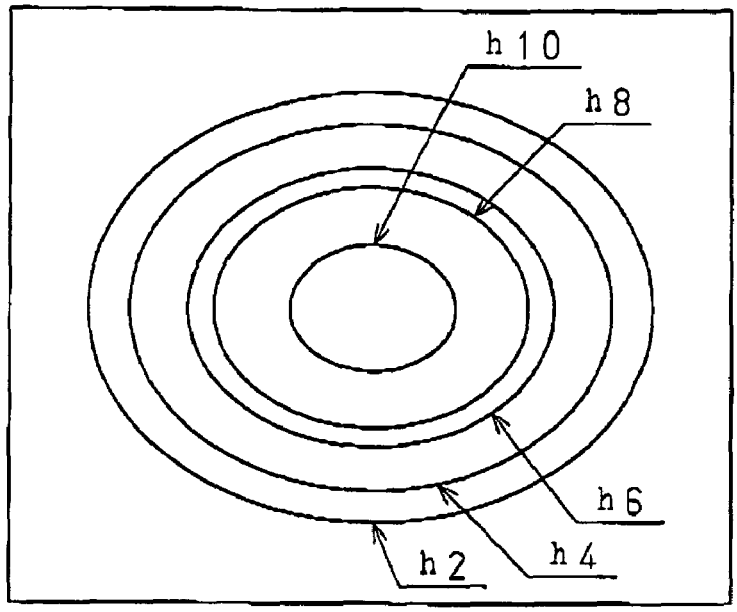
FIG. 12(A) is a contour map showing the shape of a projection formed on the outer surface of the cylinder liner in the second and fourth embodiments of the present invention.
Figure 12B:
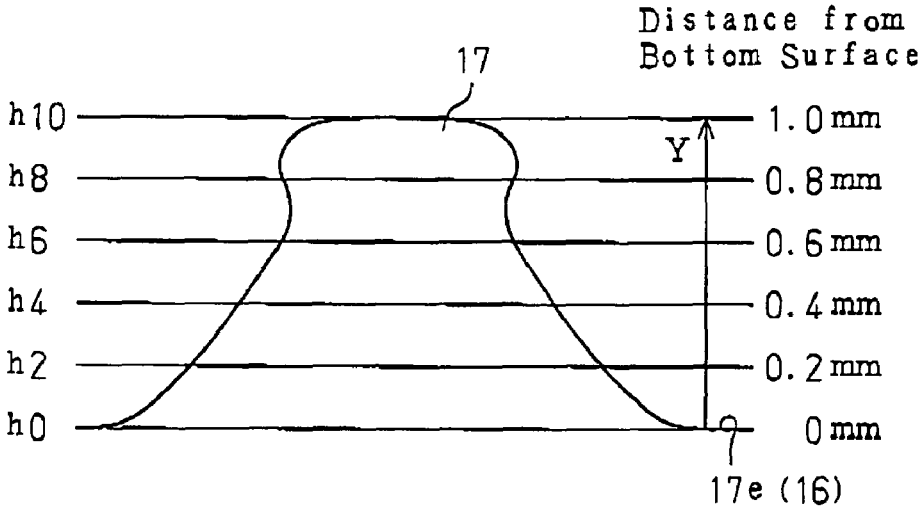
FIG. 12(B) is a graph showing the relationship between the outer surface of the cylinder liner and the height of the projection in the second and fourth embodiments.

FIG. 12(B) shows the relationship between the liner outer surface 16 and the contour lines (h0 to h10). The contour lines h for a projection 17 are taken at every predetermined distance in the height direction (direction of arrow Y) from the liner outer surface 16 (bottom surface 17*e*). The distance in the direction of the arrow Y using the liner outer surface 16 as a reference is hereinafter referred to as the "measuring height".

In the contour maps of FIGS. 12(A) and 12(B), the contour lines h are shown for every measuring height of 0.2 mm. However, the interval of the contour lines may be changed.

[a] First Area Ratio S1 of the Projection 17

Figure 13A:
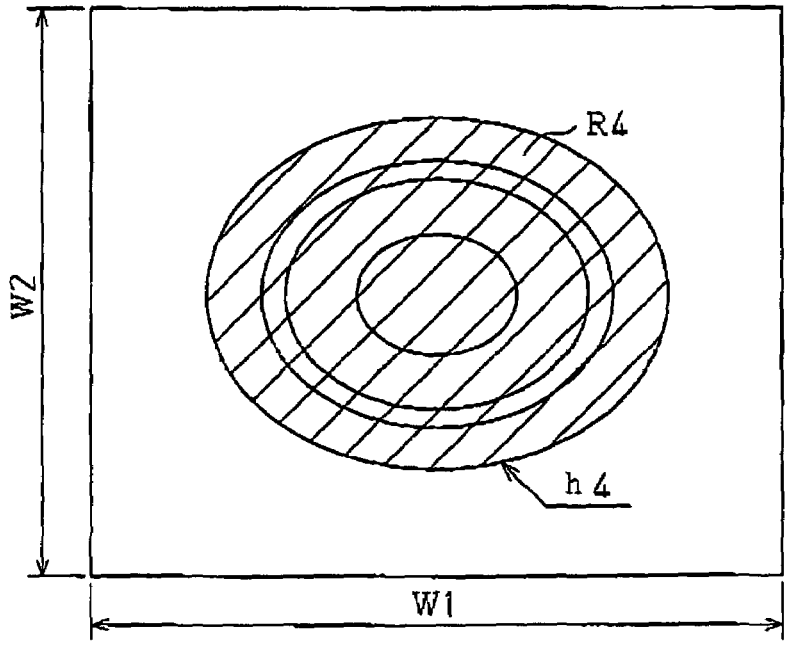
FIG. 13(A) is a contour map showing the shape of the projection formed on the outer surface of the cylinder liner in the second and the fourth embodiments.

FIG. 13(A) is a contour map (first contour map) only showing contour lines h for the measuring height of 0.4 mm or higher. The area of the contour map (W1×W2) is the unit area for obtaining the first area ratio S1.

In the first contour map, the area of the region R4 surrounded by contour line h4 (area SR4 indicated by the hatching lines in the drawing) is equivalent to the cross-sectional area of a projection at a plane lying along measuring height 0.4 mm (first cross-sectional area of the projection 17). The number of regions R4 (region quantity N4) in the first contour map corresponds to the number of projections 17 (projection number N1) in the first contour map.

The first area ratio S1 is calculated as the ratio of the total area of the region R4 (SR4×N4) occupying the area (W1×W2) of the contour map, That is, the first area ratio S1 corresponds to the total first cross-sectional area of the projection 17 occupying a unit area of the liner outer surface 16 along the plane at measuring height 0.4 mm.

The first area ratio S1 is obtained from the formula shown below.

$$S1=(SR4\times N4)/(W1\times W2)\times 100[\%]$$

[b] Second Area Ratio S2 of Projection 17

Figure 13B:
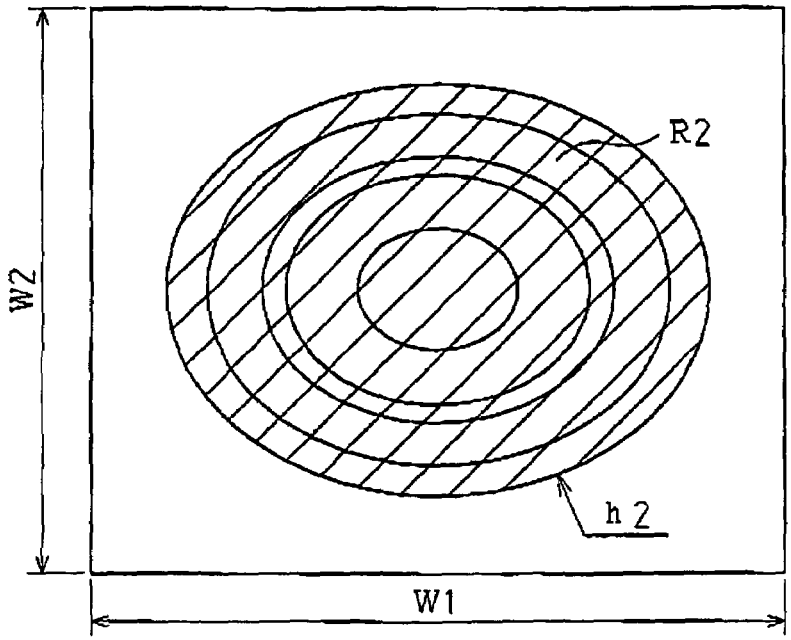
FIG. 13(B) is a contour map showing the shape of the projection formed on the outer surface of the cylinder liner in the second and the fourth embodiments.

FIG. 13(B) shows the contour map (second contour map) only showing contour lines h for the measuring height of 0.2 mm or higher. The area of the contour map (W1×W2) is the unit area for obtaining the second area ratio S2.

In the second contour map, the area of the region R2 surrounded by the contour line h2 (area SR2 indicated by the hatching lines in the drawing) is equivalent to the cross-sectional area of a projection (second cross-sectional area of the projection 17) at a plane lying along the measuring height 0.2 mm. The number of regions R2 (region quantity N2) in the second contour map corresponds to the number of projections 17 in the second contour map. The area of the second contour map is equal to the area of the first contour map. Thus, the number of the projections 17 is equal to the projection number N1.

The second area ratio S2 is calculated as the ratio of the total area of the region R2 (SR2×N2) occupying the area (W1×W2) of the contour map. That is, the second area ratio S2 corresponds to the total second cross-sectional area of the projection 17 occupying a unit area of the liner outer surface 16 along the plane at measuring height 0.2 mm.

The second area ratio S2 is obtained from the formula shown below.

$$S2=(SR2\times N2)/(W1\times W2)\times 100[\%]$$

[c] First and Second Projection Cross-Sectional Areas

The first cross-sectional area SR4 is calculated as the cross-sectional area of a projection 17 taken along the plane of measuring height 0.4 mm, and the second cross-sectional area SR2 is calculated as the cross-sectional area of a projection 17 taken along the plane of measuring height 0.2 mm. For example, image processing is performed with the contour map, the first cross-sectional area SR4 of the projection 17 is obtained by calculating the area of the region R4 in the first contour map (FIG. 13(A)), and the second cross-sectional area SR2 of the projection 17 is obtained by calculating the area of the region R2 in the second contour map (FIG. 13(B)).

[d] Projection Number

The projection number N1 is the number of projections 17 that are formed per unit area (1 $cm^2$) of the liner outer surface 16. For example, image processing is performed with the contour map, and the projection number N1 is obtained by calculating the number of regions R4 (region quantity N4) in the first contour map (FIG. 13(A)).

A cylinder liner having a first area ratio of 10% or greater was compared with a cylinder liner having a first area ratio of less than 10% with regard to the deformation amount of a bore in a cylinder block. As a result, the deformation amount of the cylinder bore of the latter cylinder liner was found to be three times greater than that of the former cylinder bore.

The gap percentage suddenly increases when a cylinder liner has a second area ratio of 55% or greater. The gap percentage is the percentage of gaps occupying the cross-section at the boundary between the cylinder liner and the cylinder block.

Based on these results, the bonding strength and adhesion of the block material and the cylinder liner are increased by applying the cylinder liner having the first area ratio of 10% or greater and the second area ratio S2 of 55% or less to the cylinder block.

The second area ratio S2 becomes 55% or less when the upper limit of the first area ratio S1 is 50%. The first area ratio S1 becomes 10% or greater when the lower limit of the second area ratio S2 is 20%.

Further Embodiments

The high melting point metal phase is aluminum or aluminum alloy in each of the above embodiments but may be copper or copper alloy. Base metal phase formed from copper or copper alloy also corresponds to the highly thermal conductive metal phase. The low melting point metal phase is zinc or zinc alloy but may be tin, tin alloy, lead, lead alloy, antimony, or antimony alloy.

In each of the above embodiments, it is only required that plural metal phases have at least two types of melting points and that at least one of the metal phases has a melting point lower than that of the block material.

For example, if two types of melting points exist in each of the above embodiments, the two melting points may be lower than that of the block material (cast metal). For example, the sprayed layer may be formed from zinc (melting point: approximately 420° C.) and tin (melting point: approximately 232° C.). In this case, when the liquid metal contacts the sprayed layer during the casting of the cylinder block, the tin of the sprayed layer melts first so that the liquid metal enters the sprayed layer in a state mixed with tin. Zinc melts thereafter but the liquid metal is already in the sprayed layer in the virtual vegetation root state. Thus, when the liquid metal is solidified, the virtual vegetation root state remains intact in the sprayed layer. A stronger bonding force is thus obtained compared to the prior art in which the liquid metal just contacts the surface layer.

In this case, it is preferable that the high melting point metal phase has a melting point that is higher than that of the block material (cast metal) to ensure the virtual vegetation root state after solidification.

Two types of metal materials are sprayed using one spraying device in the above embodiments. However, a plurality of spraying devices corresponding to each metal material may be prepared, and the metal materials may be simultaneously sprayed to the same position on the liner outer surface to form the sprayed layer, which is a heterogeneous metal layer.

In each of the above embodiments, two types of metal phases form the sprayed layer. However, as long as there is at least one dispersed metal phase distributed in the base metal phase, three or more types of metal phases may exist in the sprayed layer.

In the second and fourth embodiments, bottleneck-shaped projections may be used to obtain sufficient bonding force between the cylinder liner main body and the sprayed layer and between the cylinder liner main body and the cylinder block. In such a case, roughening of the liner outer surface does not need to be performed.

In the contour maps shown in FIGS. 12 and 13, the projections 17 may be formed so that the region R4 surrounded by the contour line h4 is shown for each projection 17. That is, the cylinder liner may be formed so that each projection 17 is independent at the position of measuring height 0.4 mm. In this case, the bonding force between the cylinder block and the cylinder liner is further enhanced.

At the position of measuring height of 0.4 mm, damage of the projection 17 and decrease in the bonding force are suppressed during manufacturing step by setting the area per projection 17 to 0.2 $mm^2$ to 3.0 $mm^2$.

The projections in the second and fourth embodiments satisfy all of the following conditions (a) to (d):

(a) the projections have a height of 0.5 mm to 1.5 mm; and (b) the projections on the outer surface are in a quantity of 5 to 60 per $cm^2$;

(c) in the contour map of the projections obtained by measuring the outer surface in the height direction of the projections with the three-dimensional laser measuring equipment, the first area ratio S1 of the region surrounded by the contour line at height 0.4 mm is 10% or greater; and (d) in the contour map of the projections obtained by measuring the outer surface in the height direction of the projections with the three-dimensional laser measuring equipment, the second area ratio S2 of the region surrounded by the contour line at height 0.2 mm is 55% or less.

Alternatively, the projections may satisfy all of the following conditions (a) to (d'):

(a) the height of the projections is 0.5 mm to 1.5 mm;

(b) the quantity of the projections on the liner outer surface is 5 to 60 per $cm^2$;

(c') in the contour map of the projections obtained by measuring the outer surface in the height direction of the projections with the three-dimensional laser measuring equipment, the first area ratio S1 of the region surrounded by the contour line at height 0.4 mm is 10% to 50%; and (d') in the contour map of the projections obtained by measuring the outer surface in the height direction of the projections with the three-dimensional laser measuring equipment, the second area ratio S2 of the region surrounded by the contour line at height 0.2 mm is 20% to 55%.

Further, the projections only need to satisfy either one of the following conditions (a) and (b):

(a) the height of the projections is 0.5 mm to 1.5 mm;

(b) the quantity of the projections on the liner outer surface is 5 to 60 per $cm^2$.

In such a case, a strong bonding force is also obtained between the cylinder liner and the cylinder block.

The projection may satisfy at least one of conditions (a) and (b) in combination with conditions (c) and (d) or conditions (c') and (d'). In this case, a strong bonding force is also obtained between the cylinder liner and the cylinder block.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. An insert casting component comprising:

an outer surface insert cast in cast metal, the outer surface having a coating of a heterogeneous metal layer, the heterogeneous metal layer including one or more dispersed metal phases in a base metal phase, wherein at least one of the dispersed metal phases is a low melting point metal phase made of a metal having a melting point lower than that of the base metal phase and the cast metal.

2. The insert casting component according to claim 1, wherein:

the cast metal is aluminum or aluminum alloy; and the low melting point metallic layer is zinc, zinc alloy, tin, tin alloy, lead, lead alloy, antimony, or antimony alloy.

3. The insert casting component according to claim 1, wherein the base metal phase is a highly thermal conductive metal phase.

4. The insert casting component according to claim 3, wherein the highly thermal conductive metal phase is formed of aluminum, aluminum alloy, copper or copper alloy.

5. The insert casting component according to claim 1, wherein the base metal phase has a melting point that is the same as or higher than that of the cast metal.

6. The insert casting component according to claim 1, wherein the heterogeneous metal layer is formed by simultaneously spraying the outer surface with the materials of all the metal phases forming the heterogeneous metal layer.

7. The insert casting component according to claim 6, wherein the heterogeneous metal layer is formed by powder spraying a mixture of a plurality of powdered materials.

8. The insert casting component according to claim 6, wherein the heterogeneous metal layer is formed by electric arc spraying a plurality of wire materials.

9. The insert casting component according to claim 1, wherein the insert casting component is a cylinder liner bonded to a cylinder block of an internal combustion engine by insert casting the outer surface of the cylinder liner in cast metal when casting the cylinder block.

10. The insert casting component according to claim 9, wherein a plurality of bottleneck-shaped projections are formed on the outer surface, the projections satisfying at least one of the following conditions:

(a) the projections having a height of 0.5 mm to 1.5 mm; and (b) the projections on the outer surface being in a quantity of 5 to 60 per $cm^2$.

11. The insert casting component according to claim 10, wherein the projections further satisfy all of the following conditions:

(c) in a contour map of the projections obtained by measuring the outer surface in the height direction of the projections with a three-dimensional laser measuring equipment, an area ratio S1 is 10% or greater, where S1 is the area ratio of a region surrounded by a contour line of height 0.4 mm; and (d) in a contour map of the projections obtained by measuring the outer surface in the height direction of the projections with the three-dimensional laser measuring equipment, an area ratio S2 is 55% or less, where S2 is the area ratio of a region surrounded by a contour line of height 0.2 mm.

12. The insert casting component according to claim 10, wherein the projections further satisfy all of the following conditions:

(c') in a contour map of the projections obtained by measuring the outer surface in the height direction of the projections with a three-dimensional laser measuring equipment, an area ratio S1 is 10% to 50%, where S1 is the area ratio of a region surrounded by a contour line of height 0.4 mm; and (d') in a contour map of the projections obtained by measuring the outer surface in the height direction of the projections with the three-dimensional laser measuring equipment, an area ratio S2 is 20% to 55%, where S2 is the area ratio of a region surrounded by a contour line of height 0.2 mm.

13. The insert casting component according to claim 11, wherein the projections further satisfy all of the following conditions:

(e) the regions surrounded by the contour line of height 0.4 mm are independent from each other in the contour map; and (f) the area of the regions surrounded by the contour line of height 0.4 mm is 0.2 $mm^2$ to 3.0 $mm^2$ in the contour map.

14. The insert casting component according to claim 12, wherein the projections further satisfy all of the following conditions:

(e) the regions surrounded by the contour line of height 0.4 mm are independent from each other in the contour map; and (f) the area of the regions surrounded by the contour line of height 0.4 mm is 0.2 $mm^2$ to 3.0 $mm^2$ in the contour map.

15. A cylinder block comprising:

a cylinder liner including an outer surface insert cast in cast metal, the outer surface having a coating of a heterogeneous metal layer, the heterogeneous metal layer including one or more dispersed metal phases in a base metal phase, wherein at least one of the dispersed metal phases is a low melting point metal phase made of a metal having a melting point lower than that of the base metal phase and the cast metal.

16. A method for forming a coating on an insert casting component including an outer surface insert cast in cast metal, the method comprising the step of:

spraying the outer surface with plural types of metal material simultaneously, including a low melting metal material having a melting point lower than that of the cast metal and a high melting point metal material having a melting point higher than that of the low melting point metal material, and forming a heterogeneous metal layer in which low melting point metal phases of the low melting point metal material are dispersed in a high melting point metal phase of the high melting point metal material.

17. The method according to claim 16, wherein the step of spraying is performed using the high melting point metal material having a melting point that is the same as or higher than that of the cast metal.

18. The method according to claim 16, wherein the step of spraying is performed using a highly thermal conductive metal material as the high melting point metal material.

19. The method according to claim 16, wherein the step of spraying uses a powdered material mixture of the low melting point metal material and the high melting point metal material.

20. The method according to claim 16, wherein the step of spraying is performed through electric arc spraying using plural types of wire materials including the low melting point metal material and the high melting point metal material.

21. The method according to claim 16, wherein the step of spraying is performed on the insert casting component including a plurality of bottleneck-shaped projections on the outer surface, the projections satisfying at least one of the following conditions:

(a) the projections having a height of 0.5 mm to 1.5 mm; and (b) the projections on the outer surface being in a quantity of 5 to 60 per $cm^2$.

22. The method according to claim 21, wherein the step of spraying is performed on the insert casting component including the plurality of bottleneck-shaped projections on the outer surface, the projections further satisfying all of the following conditions:

(c) in a contour map of the projections obtained by measuring the outer surface in the height direction of the projections with a three-dimensional laser measuring equipment, an area ratio S1 is 10% or greater, where S1 is the area ratio of a region surrounded by a contour line of height 0.4 mm; and (d) in a contour map of the projections obtained by measuring the outer surface in the height direction of the projections with the three-dimensional laser measuring equipment, an area ratio S2 is 55% or less, where S2 is the area ratio of a region surrounded by a contour line of height 0.2 mm.

23. The method according to claim 21, wherein the step of spraying is performed on the insert casting component including the plurality of bottleneck-shaped projections on the outer surface, the projections further satisfying all of the following conditions:

(c') in a contour map of the projections obtained by measuring the outer surface in the height direction of the projections with a three-dimensional laser measuring equipment, an area ratio S1 is 10% to 50%, where S1 is the area ratio of a region surrounded by a contour line of height 0.4 mm; and (d') in a contour map of the projections obtained by measuring the outer surface in the height direction of the projections with the three-dimensional laser measuring equipment, an area ratio S2 is 20% to 55%, where S2 is the area ratio of a region surrounded by a contour line of height 0.2 mm.

24. The method according to claim 22, wherein the step of spraying is performed on the insert casting component including the plurality of bottleneck-shaped projections on the outer surface, the projections further satisfying all of the following conditions:

(e) the regions surrounded by the contour line of height 0.4 mm are independent from each other in the contour map; and (f) the area of the regions surrounded by the contour line of height 0.4 mm is 0.2 $mm^2$ to 3.0 $mm^2$ in the contour map.

25. The method according to claim 23, wherein the step of spraying is performed on the insert casting component including the plurality of bottleneck-shaped projections on the outer surface, the projections further satisfying all of the following conditions:

(e) the regions surrounded by the contour line of height 0.4 mm are independent from each other in the contour map; and (f) the area of the regions surrounded by the contour line of height 0.4 mm is 0.2 $mm^2$ to 3.0 $mm^2$ in the contour map.

26. A method for manufacturing a cylinder block by insert casting an outer surface of a cylinder liner in cast metal, the method comprising the step of:

spraying the outer surface with plural types of metal material simultaneously, including a low melting metal material having a melting point lower than that of the cast metal and a high melting point metal material having a melting point higher than that of the low melting point metal material, and forming a heterogeneous metal layer in which low melting point metal phases of the low melting point metal material are dispersed in a high melting point metal phase of the high melting point metal material.

* * * * *